US007070163B2

(12) United States Patent
Tochiyama et al.

(10) Patent No.: US 7,070,163 B2
(45) Date of Patent: Jul. 4, 2006

(54) ELECTROMAGNETIC VALVE

(75) Inventors: Shigenobu Tochiyama, Tokyo (JP); Yoshihiko Onishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 168 days.

(21) Appl. No.: 10/702,722

(22) Filed: Nov. 7, 2003

(65) Prior Publication Data

US 2004/0231335 A1 Nov. 25, 2004

(30) Foreign Application Priority Data

Nov. 8, 2002 (JP) ..... 2002-325080
Oct. 2, 2003 (JP) ..... 2003-344393

(51) Int. Cl.
*F02M 59/36* (2006.01)

(52) U.S. Cl. ..... 251/129.15

(58) Field of Classification Search ..... 251/129.15
See application file for complete search history.

(56) References Cited

U.S. PATENT DOCUMENTS

| | | | | |
|---|---|---|---|---|
| 4,530,319 | A | 7/1985 | Honda | |
| 4,621,598 | A | 11/1986 | Miura | |
| 4,834,134 | A | 5/1989 | Asami et al. | |
| 5,333,836 | A * | 8/1994 | Fukuyo et al. | 251/129.15 |
| 5,984,263 | A * | 11/1999 | Hosoya | 251/129.15 |
| 6,664,877 | B1 * | 12/2003 | Sato et al. | 335/255 |

FOREIGN PATENT DOCUMENTS

| | | | |
|---|---|---|---|
| DE | 3439378 | C2 | 4/1986 |
| DE | 3933331 | A1 | 4/1991 |
| DE | 19404185 | A1 | 8/1996 |
| DE | 195 33 741 | A1 | 3/1997 |
| DE | 19535945 | A1 | 4/1997 |
| DE | 19717445 | A1 | 10/1998 |
| DE | 19956160 | A1 | 5/2001 |
| DE | 10148684 | A1 | 4/2002 |
| JP | 61-261654 | A | 11/1986 |
| JP | 63-13975 | | 1/1988 |
| JP | 6-213356 | | 8/1994 |
| JP | 2001-41342 | | 2/2001 |

* cited by examiner

*Primary Examiner*—J. Casimer Jacyna
(74) *Attorney, Agent, or Firm*—Sughrue Mion, PLLC

(57) ABSTRACT

An electromagnetic valve can be reduced in size, and improved in the machinability and workability of a body thereof. A plunger (40) is arranged on an axis of a solenoid (47) for axial movement, and a body (41) with the plunger (40) slidably received therein is fixedly arranged in a housing (44). A valve seat (42) is arranged in opposition to one end of the plunger (40) in such a manner that the one end of the plunger (40) is moved to contact with and separate from the valve seat (42). The plunger (40) is urged toward the valve seat (42) by means of a spring (48). The body (41) is formed with an engagement groove (50), into which a caulking portion (51), which is formed by bending or flexing the one end of the housing (44), is engaged to integrally couple the body (41) and the housing (44) with each other.

20 Claims, 11 Drawing Sheets

ELECTROMAGNETIC VALVE

BACKGROUND OF THE INVENTION

1. Field of the Invention

The present invention relates to an electromagnetic valve for use with a high-pressure fuel supply system for controlling the amount of fuel discharge of a fuel pump that supplies a high-pressure fuel to an internal combustion engine for instance.

2. Description of the Related Art

In the past, an electromagnetic (or solenoid) valve has been known which includes a solenoid, a plunger arranged on an axis of the solenoid for movement in an axial direction thereof, a body in which the plunger is slidably received, a housing in which the body is arranged and fixedly secured to an inner surface thereof, a valve seat arranged in opposition to one end of the plunger so that the one end of the plunger can be moved into or away from the valve seat, and a spring for urging the plunger toward the valve seat. The body is composed of a large diameter portion and a small diameter portion, and a caulking portion, which is formed by bending or flexing the one end of the housing, is engaged with a stepped portion between the large diameter portion and the small diameter portion, whereby the body and the housing are integrally coupled with each other (for instance, see a first patent document: Japanese patent laid-open No. Sho 61-261654).

In the electromagnetic valve as constructed above, in order to form the stepped portion for engaging the caulking portion, the body is constructed of the large diameter portion and the small diameter portion. As a result, there arises a problem that the outside diameter of the body becomes large, accordingly increasing the size of the electromagnetic valve itself.

In addition, since the stepped portion is located on the outer peripheral surface of the body, there also arises another problem that it is necessary to employ two separate processes for forming the entire outer peripheral surface of the body, i.e., one process for forming the large diameter portion and another process for forming the small diameter portion.

SUMMARY OF THE INVENTION

The present invention is intended to obviate the above-mentioned problems, and has for its object to provide an electromagnetic valve which can be reduced in size and improved in machinability and workability.

In an electromagnetic valve according to the present invention, a body is formed with an engagement groove, into which a caulking portion, which is formed by bending or flexing one end of a housing, is engaged, thereby integrally coupling the body and the housing with each other.

The above and other objects, features and advantages of the present invention will become more readily apparent to those skilled in the art from the following detailed description of a preferred embodiment of the present invention taken in conjunction with the accompanying drawings.

DESCRIPTION OF THE PREFERRED EMBODIMENTS

Figure 1:
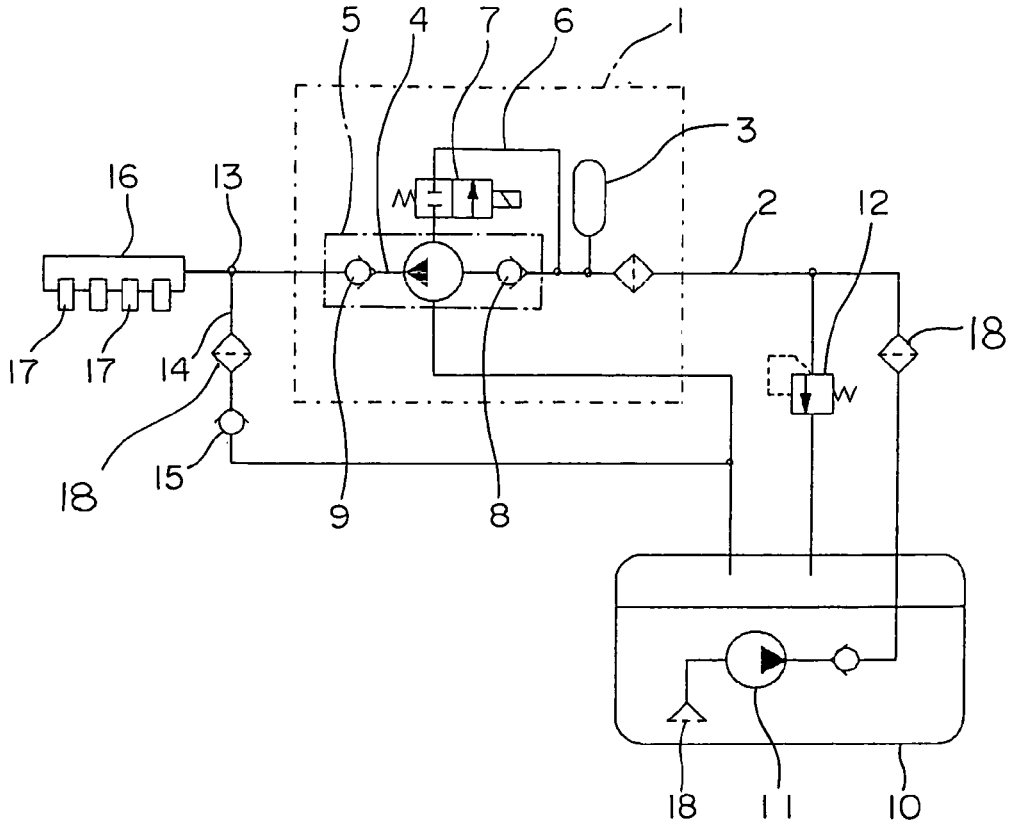
FIG. 1 is a circuit diagram of a high-pressure fuel supply system incorporating therein an electromagnetic valve which is constructed in accordance with a first embodiment of the present invention.

Hereafter, preferred embodiments of the present invention will be described in detail while referring to the accompanying drawings. The same or equivalent members and parts are identified by the same reference characters throughout the following description of the preferred embodiments and figures of the accompanying drawings.

EMBODIMENT 1

FIG. 1 is a hydraulic circuit diagram including a high-pressure fuel supply system 1 according to a first embodiment of the present invention.

This high-pressure fuel supply system 1 includes a low-pressure damper 3 arranged on a low-pressure fuel suction passage 2 for absorbing the pulsation of a low-pressure fuel, a high-pressure fuel pump 5 for pressurizing the low-pressure fuel from a low-pressure damper 3 to discharge it to a high-pressure fuel discharge passage 4, a relief passage 6 connecting between a suction side of the high-pressure fuel pump 5 and a pressurization chamber, and an electromagnetic valve 7 arranged on the relief passage 6 and being operated to open for adjusting the amount of fuel discharged from the high-pressure fuel pump 5. The high-pressure fuel pump 5 has a suction valve 8 and a discharge valve 9.

In the neighborhood of the high-pressure fuel supply system 1, there are provided a fuel tank 10, a low-pressure fuel pump 11 arranged in the fuel tank 10, a low-pressure regulator 12 branched from the low-pressure fuel suction passage 2 for regulating the low-pressure fuel so as to be at a constant pressure, a relief valve 15 arranged on a drain pipe 14 branched from the high-pressure fuel discharge passage 4 at a branch portion 13, a delivery pipe 16 connected with the high-pressure fuel discharge passage 4, a plurality of fuel injection valves 17 connected with the delivery pipe 16, and a plurality of filters 18 connected with the low-pressure fuel pump 11 and the like.

Figure 2:
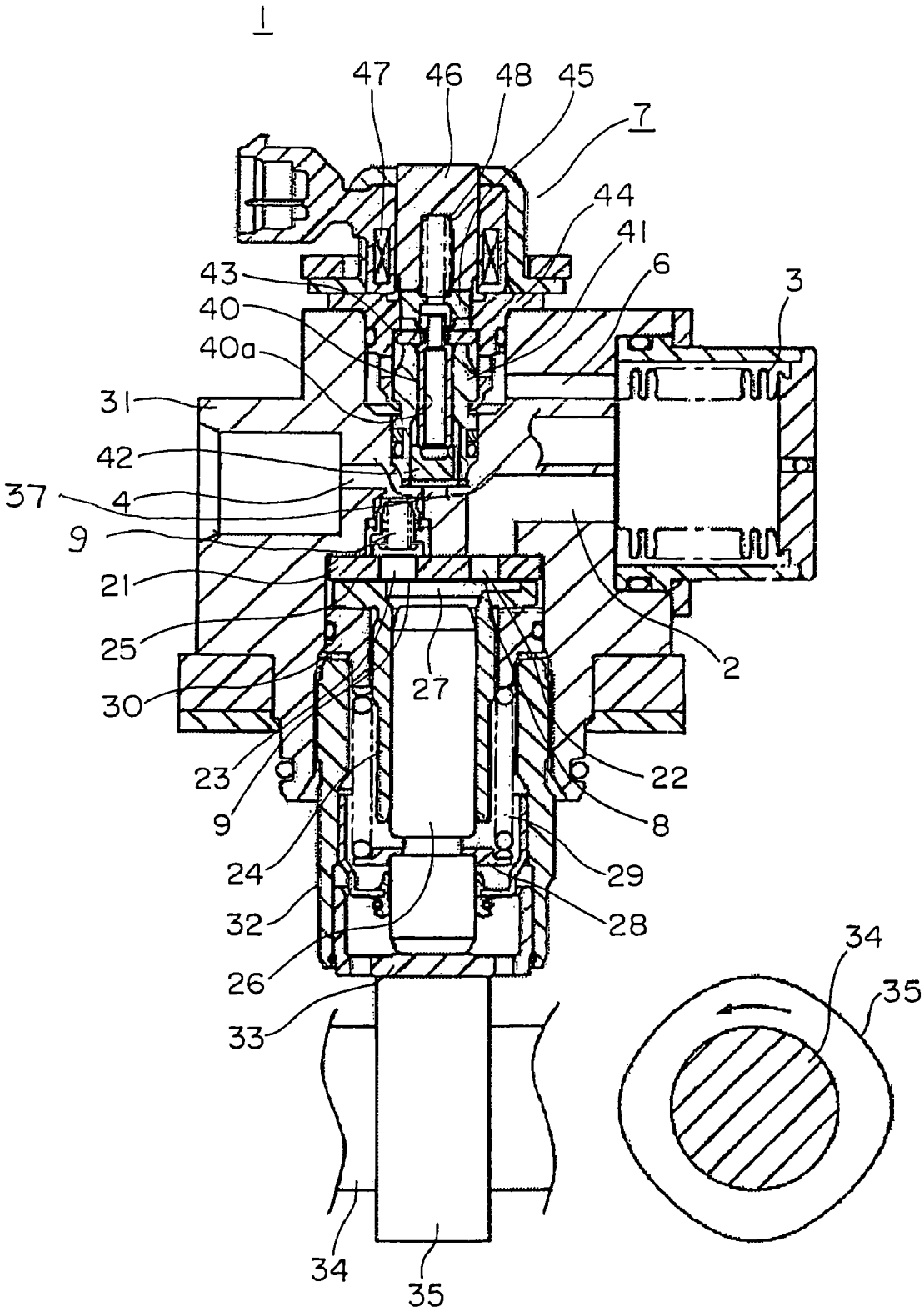
FIG. 2 is a cross sectional view of a high-pressure fuel pump shown in FIG. 1. incorporating therein an electromagnetic valve which is constructed in accordance with a first embodiment of the present invention.

FIG. 2 is a cross sectional view of the high-pressure fuel supply system 1 of FIG. 1.

The high-pressure fuel pump 5 of the high-pressure fuel supply system 1 includes a plate 21 having a fuel suction port 22 connected with the low-pressure fuel suction passage 2 and a fuel discharge port 23 connected with the high-pressure fuel discharge passage 4, a sleeve 24 of a cylindrical shape, a valve disc 25 having the suction valve 8 and arranged between an upper end face of the sleeve 24 and the plate 21, the discharge valve 9 arranged on the high-pressure fuel discharge passage 4, a piston 26 slidably received in the sleeve 24 to define a fuel pressurization chamber 27 in cooperation with the sleeve 24 for pressurizing the fuel that flows into the fuel pressurization chamber 27, and a spring 29 arranged under compression between a receiving portion 28 and a bracket 30 for urging the piston 26 in a direction to enlarge the volume of the fuel pressurization chamber 27.

In addition, the high-pressure fuel pump 5 includes a casing 31 having the low-pressure fuel suction passage 2 and the high-pressure fuel discharge passage 4, a housing 32 fixedly attached to the casing 31, and a tappet 33 slidably arranged at a tip end of the housing 32 and adapted to be placed into abutting engagement with a cam 35 fixedly secured to a camshaft 34 for causing the piston 26 to reciprocate in accordance with the profile of the cam 35.

Figure 3:
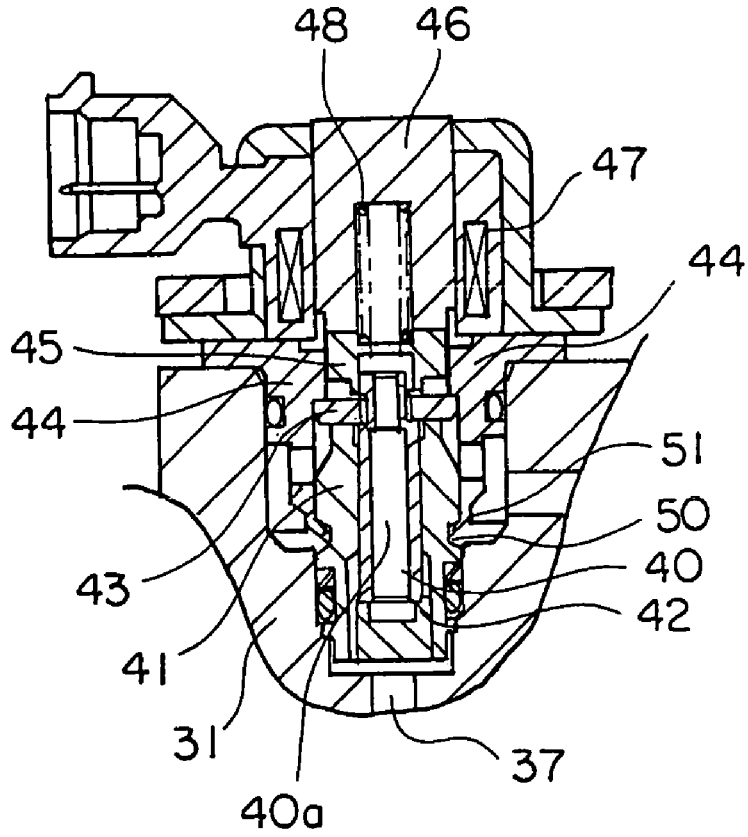
FIG. 3 is a cross sectional view of the electromagnetic valve shown in FIG. 2.

FIG. 3 is an enlarged view of the electromagnetic valve 7 of FIG. 2. The electromagnetic valve 7 includes a plunger 40 having a fuel passage 40*a* formed therein along the axis thereof, a body 41 that is fitted in the casing 31 and a housing 44 and slidably receives the plunger 40, a valve seat 42 arranged in pressure contact with an end of the plunger 40 and welded to the body 41, a stopper 43 of a C-shaped configuration fixedly mounted on the housing 44 for limiting the amount of lift of the plunger 40 upon opening thereof, an armature 45 made of a magnetic material and welded to the plunger 40, a core 46 arranged in opposition to the armature 45, a solenoid 47 wound around the core 46, and a spring 48 arranged under compression inside the core 46 for urging the plunger 40 through the armature 45 in a direction toward the valve seat 42.

The body 41 is formed with an engagement groove 50. A caulking portion 51 is formed by bending or flexing the one end of the housing 44. The caulking portion 51 is engaged into the engagement groove 50, the body 41 and the housing 44 is integrally coupled with each other.

With the high-pressure fuel supply system 1 as constructed above, the piston 26 is caused to reciprocate through the intermediary of the tappet 33 in accordance with the rotation of the cam 35 fixedly attached to the camshaft 34 of the engine.

When the piston 26 descends (on the fuel suction stroke), the volume of the fuel pressurization chamber 27 increases to reduce the pressure therein. As a result, the suction valve 8 is opened so that the fuel in the low-pressure fuel supply passage 2 flows into the fuel pressurization chamber 27 through the fuel suction port 22.

When the piston 26 ascends (on the fuel discharge stroke), the pressure in the fuel pressurization chamber 27 increases to open the discharge valve 9 so that the fuel in the fuel pressurization chamber 27 is supplied to the delivery pipe 16 through the fuel discharge port 23 and the high-pressure fuel discharge passage 4. Thereafter, the fuel is supplied to the fuel injection valves 17 which serve to inject the fuel to respective cylinders (not shown) of the engine.

Moreover, when the solenoid 47 is energized, magnetic attraction is generated between the armature 45 and the core 46 to cause the plunger 40 to move away from the valve seat 42 to the stopper 43 against the resilient force of the spring 48, thereby opening the electromagnetic valve 7. As a consequence, the relief passage 6 is placed in fluid communication with the fuel pressurization chamber 27 through the fuel passage 40*a* in the plunger 40 and the communication port 37 so that the pressure in the fuel pressurization chamber 27 is reduced to permit the discharge valve 9 to be closed, thereby stopping the supply of the high-pressure fuel to the fuel injection valve 17, the fuel flows to the relief passage 6.

On the other hand, when the solenoid 47 is deenergized, the magnetic attraction between the armature 45 and the core 46 becomes zero so that the plunger 40 is placed in pressure contact with the valve seat 42 under the action of the resilient force of the spring 48, thereby closing the electromagnetic valve 7 and hence the relief passage 6.

Figure 4:
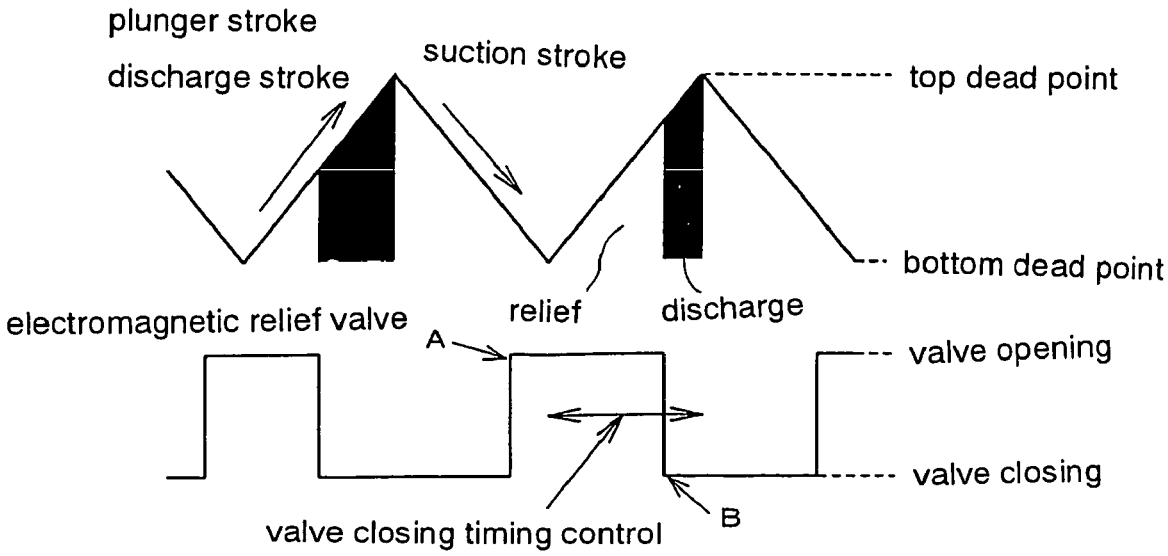
FIG. 4 is a timing chart showing the relation between the driving of the electromagnetic valve and the suction and discharge strokes of the high-pressure fuel pump shown in FIG. 3.

Hereafter, when the piston 26 ascends, as explained above, the fuel in the fuel pressurization chamber 27 is supplied to the delivery pipe 16 through the fuel discharge 23 and the fuel suction port 22. FIG. 4 is a timing chart that shows the relation between the driving of the electromagnetic valve 7 and the suction and discharge strokes of the high-pressure fuel pump 5. In FIG. 6, an upper portion represents the amount of plunger lift; a black painted portion represents an area where fuel is discharged from the high-pressure fuel pump 5; and a lower portion represents the driving state of the electromagnetic valve 7. As can be seen from this figure, the amount of fuel discharged from the high-pressure fuel pump 5 on the fuel discharge stroke can be adjusted by controlling the driving timing of the electromagnetic valve 7.

Figure 5A:
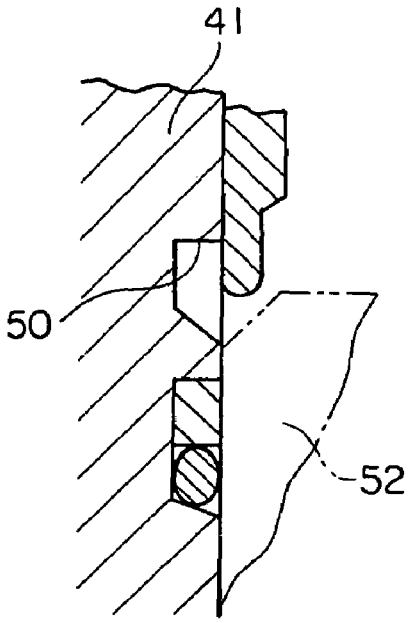
FIG. 5A is a partial cross sectional view showing the state before a lower end portion of a housing is bent or flexed toward a body shown in FIG. 3.
Figure 5B:
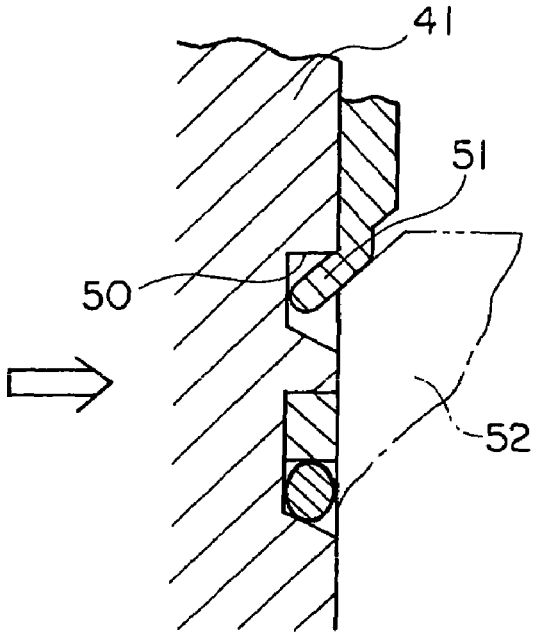
FIG. 5B is a partial cross sectional view showing the state where the lower end portion of the housing is bent or flexed toward the body shown in FIG. 3.

Incidentally, FIG. 5A is a view that shows the state before the lower end portion of the housing 44 is bent or flexed toward the body 41. FIG. 5B is a view that shows the state where the lower end portion of the housing 44 is bent or flexed toward the body 41, and the caulking portion 51 is engaged into the engagement groove 50.

Figure 6A:
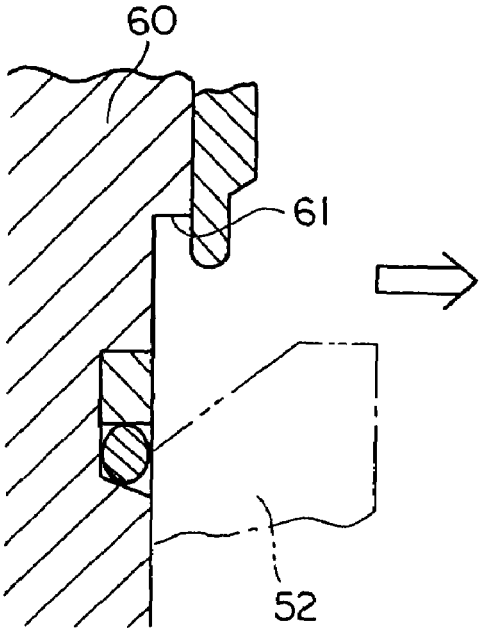
FIG. 6A is a partial cross sectional view showing the state before a lower end portion of a known housing is bent or flexed toward a body.
Figure 6B:
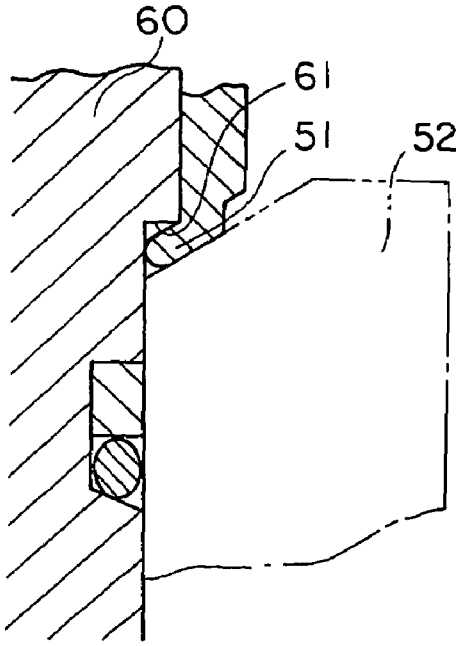
FIG. 6B is a partial cross sectional view showing the state where the lower end portion of the known housing is bent or flexed toward the body.

FIG. 6A is a view that shows the state before a lower end portion of a housing 44 is bent or flexed toward a body 60 having a stepped portion 61 in the case of a prior art. FIG. 6B is a view that shows the state where the lower end portion of the housing 44 is bent or flexed toward the body 60, and a caulking portion 51 is engaged into the stepped portion 61 in the case of the prior art.

In this embodiment, as compared with the body 60 having the stepped portion 61 of the prior art, the stepped portion 61 for engaging the caulking portion 51 is not required, thus making it possible to accordingly reduce the diametral size of the body 41 and hence the entire size of the electromagnetic valve 7.

In addition, since no stepped portion is formed on the outer peripheral surface of the body 41, it is possible to form the outer peripheral surface of the body 41 in one process, thereby improving the machinability and workability thereof.

Incidentally, in the prior art, a circular-shaped jig 52 sliding on the outer peripheral surface of the body 60 is pressed against the housing 44 from a lower end portion side thereof so that the lower end portion of the housing 44 is bent or flexed to deform, thus placing the caulking portion 51 into engagement with the stepped portion 61. As a result, the body 60 and the housing 44 are integrally coupled with each other. As shown in FIG. 6B, the lower end portion of the housing 44 is bent or flexed to deform while being clamped between the stepped portion 61 and the jig 52. A pressing or urging force from the jig 52 is transmitted mainly in an axial direction of the body 60 through the caulking portion 51, and hence there will be generated substantially no diametral or radial deformation of the body 60.

In contrast to this, according to this embodiment, a circular-shaped jig 53 sliding on the outer peripheral surface of the body 41 is pressed against the housing 44 from a lower end portion side thereof, whereby the lower end portion of the housing 44 is bent or flexed to deform. As a consequence, the caulking portion 51 is engaged into the engagement groove 50, thus integrally coupling the body 41 and the housing 44 with each other. As shown in FIG. 5B, when the jig 52 passes over the engagement groove 50, the lower end portion of the housing 44 is bent or flexed to deform, and hence there is a possibility that the majority of the pressing or urging force from the jig 52 is transmitted through the caulking portion 51 in a diametral or radial direction of the body 41. Moreover, when the jig 52 is press-fitted onto the body 41 toward the stopper 43 side to an extent more than necessary, such a possibility becomes particularly high, so the body 41 is accordingly more likely to be deformed in a diametral or radial direction. Though the strength of engagement in the diametral direction is sufficient in this case, there will be a high possibility that the axial engaging strength of the caulking portion 51 with respect to the body 41 becomes unstable.

Figure 7:
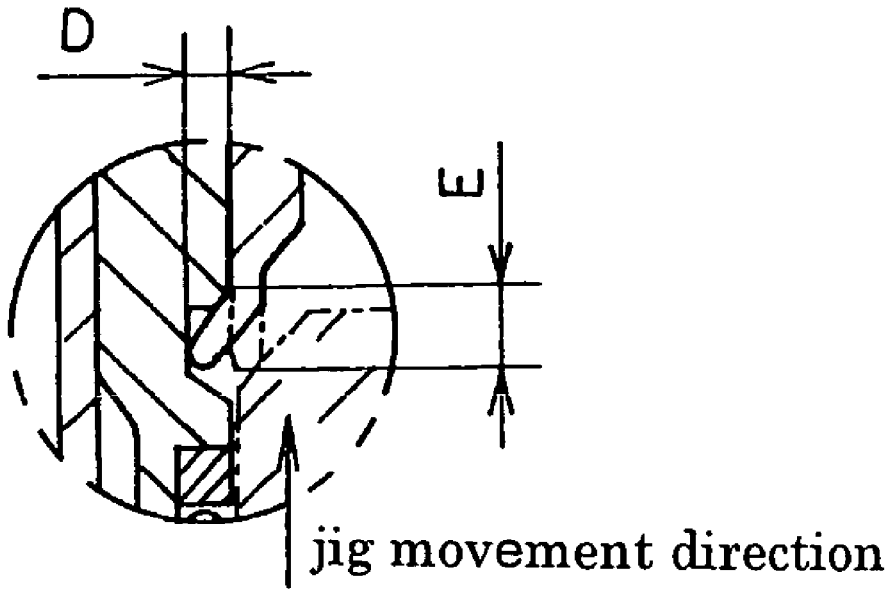
FIG. 7 is a view showing the depth D of an engagement groove and the bent length E of a caulking portion according to the present invention.
Figure 8:
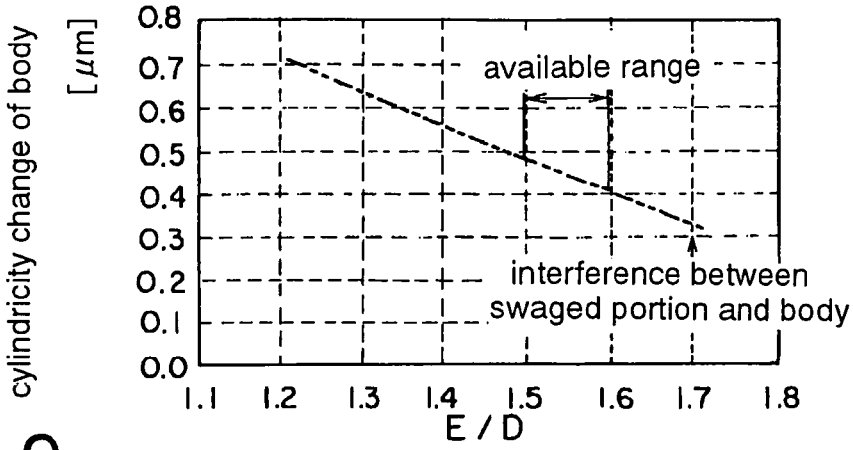
FIG. 8 is a chart showing the relation between the ratio (E/D) and the change of cylindricity of the body according to the present invention.
Figure 9:
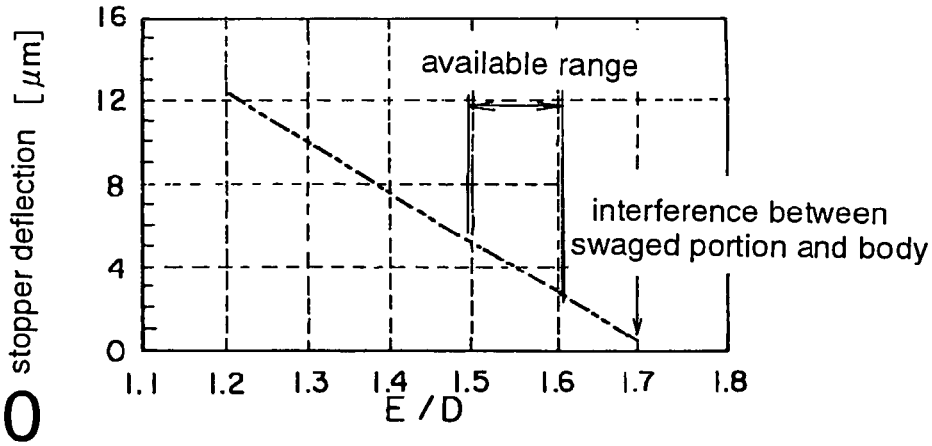
FIG. 9 is a chart showing the relation between the ratio (E/D) and the deflection of a stopper according to the present invention.
Figure 10:
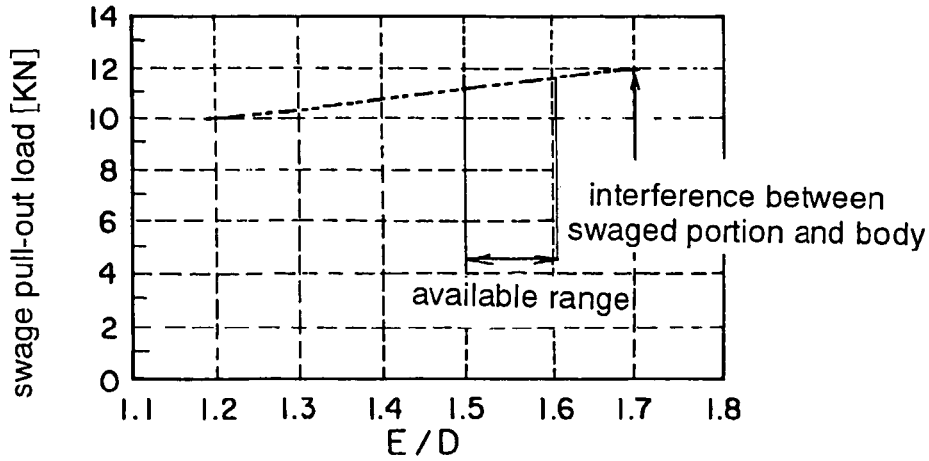
FIG. 10 is a chart showing the relation between the ratio (E/D) and the caulking pull-out load according to the present invention.

In connection with this, the inventor of the present application has found the following from the experimental results shown in FIG. 8 through FIG. 10. That is, by setting the relation between the depth D of the engagement groove 50 and the bent length E of the caulking portion 51 (see FIG. 7) to be $1.5<E/D<1.6$, the diametral or radial deformation of the body 41 can be reduced, and the axial engaging strength of the caulking portion 51 with respect to the body 41 can also be stabilized. In this range of the ratio (E/D), a tip end of the caulking portion 51 is not in contact with the bottom of the engagement groove 50 so as to reduce the diametral deformation of the body 41.

Note that FIG. 8 is a chart showing the relation between the ratio (E/D) and the cylindricity change of the body 41 (i.e., a difference between a maximum inner diameter and a minimum inner diameter of the body 41). FIG. 9 is a chart showing the relation between the ratio (E/D) and the amount of stopper deflection. FIG. 10 is a chart showing the relation between the ratio (E/D) and the caulking pull-out load (i.e., the load by which the body 41 can be pulled out from the housing 44 in an axial direction thereof).

EMBODIMENT 2

Figure 11A:
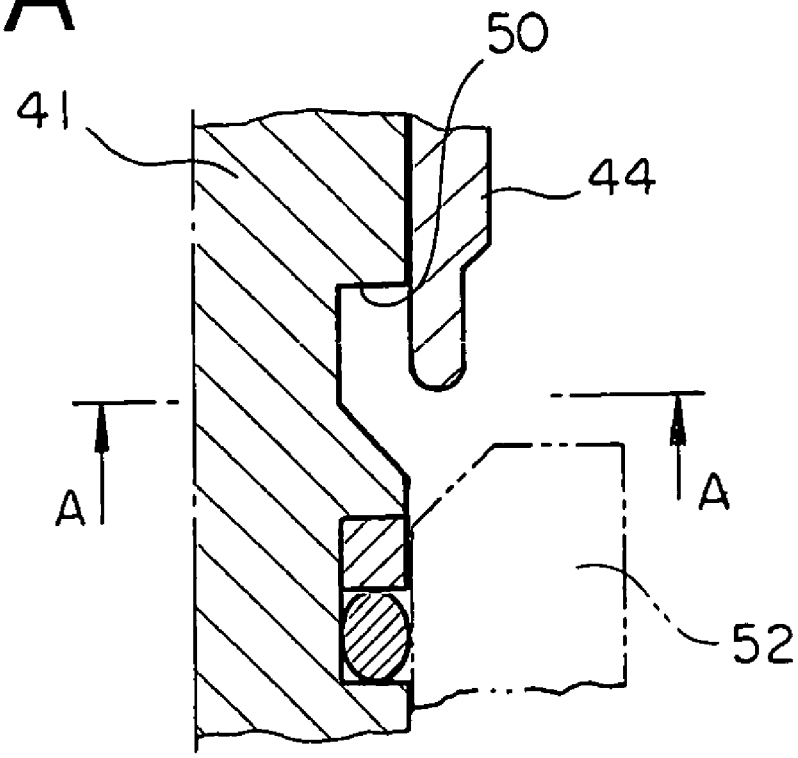
FIG. 11A is a partial cross sectional view of an electromagnetic valve according to a second embodiment of the present invention before a housing is fixed to a body.
Figure 11B:
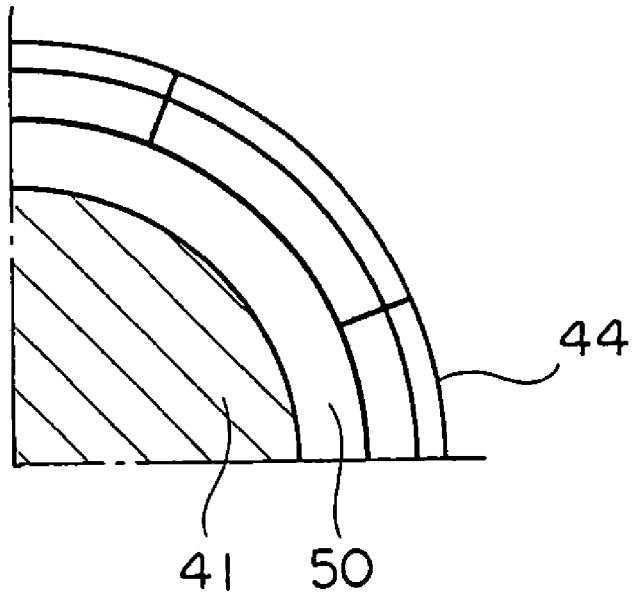
FIG. 11B is an arrow cross sectional view along line A—A in FIG. 11A.

FIG. 11A is a partial cross sectional view of an electromagnetic valve according to a second embodiment of the present invention before a housing 44 is fixed to a body 41, and FIG. 11B is an arrow cross sectional view along line A—A in FIG. 11A.

Figure 12A:
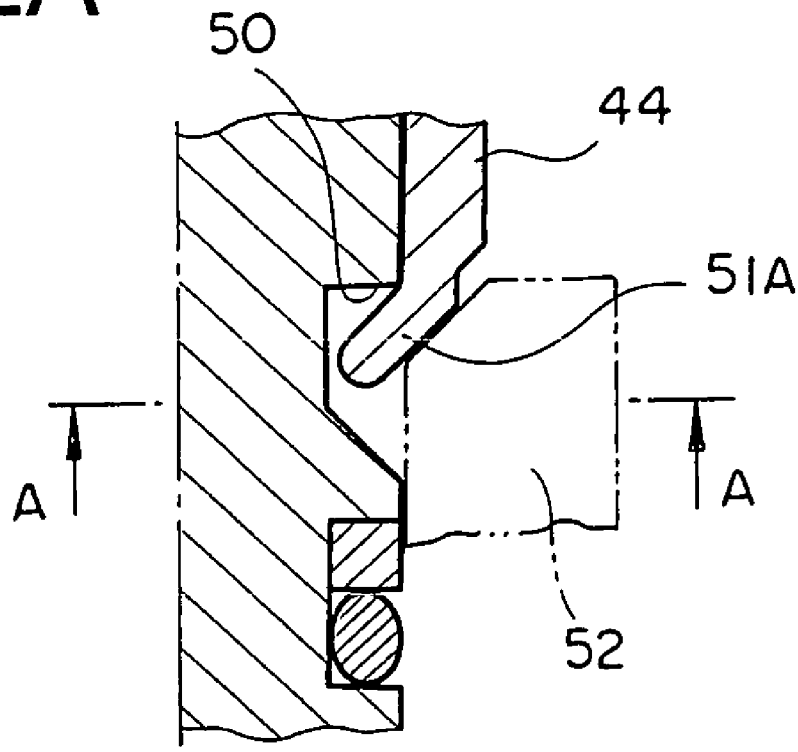
FIG. 12A is a partial cross sectional view of the electromagnetic valve according to the second embodiment of the present invention when the housing is fixed to the body.
Figure 12B:
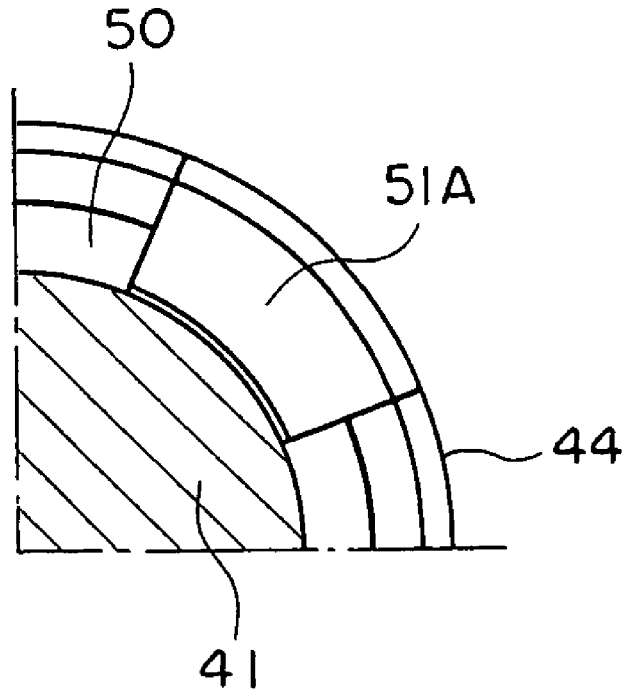
FIG. 12B is an arrow cross sectional view along line A—A in FIG. 12A.

FIG. 12A is a partial cross sectional view of the electromagnetic valve according to the second embodiment of the present invention when the housing 44 is fixed to the body 41, and FIG. 12B is an arrow cross sectional view along line A—A in FIG. 12A.

In the above-mentioned first embodiment, the engagement groove 50 is formed over the entire periphery of the body 41, and the caulking portion 51 is also formed over the entire periphery of the housing 44. In contrast to this, in this embodiment, a plurality of caulking segments 51A are formed at equal intervals in a circumferential direction of the housing 44. The construction of this embodiment other than this is the same as that of the first embodiment.

According to this embodiment, the plurality of caulking segments 51A, which are formed by bending or flexing the lower end portion of the housing 44, are engaged with the engagement groove 50. As a result, a bending or flexing load required, which is applied to the housing 44 for bending or flexing deformation of the caulking segments 51A, may be smaller as compared with that required of the first embodiment. In addition, a diametral or radial load acting on the body 41 becomes small, and hence the body 41 is not easily deformed in the diametral or radial direction.

EMBODIMENT 3

Figure 13A:
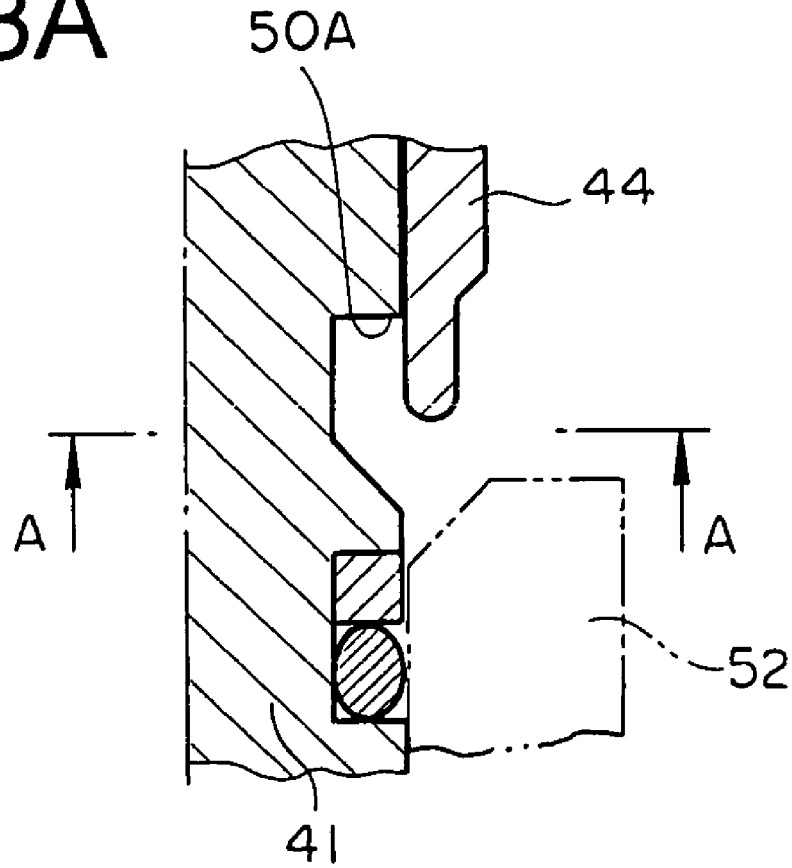
FIG. 13A is a partial cross sectional view of an electromagnetic valve according to a third embodiment of the present invention before a housing is fixed to a body.
Figure 13B:
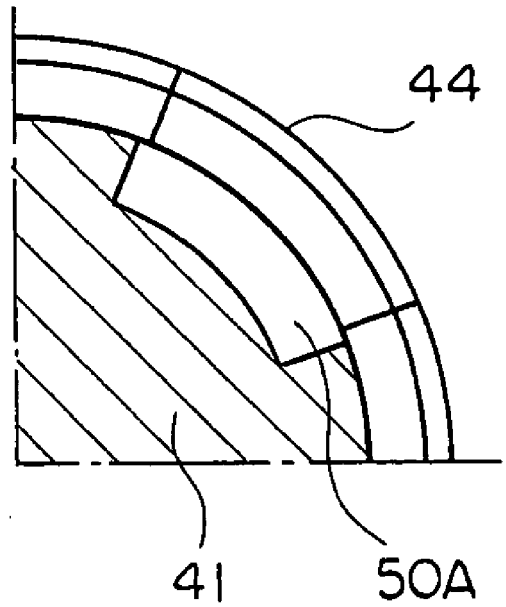
FIG. 13B is an arrow cross sectional view along line A—A in FIG. 13A.

FIG. 13A is a partial cross sectional view of an electromagnetic valve according to a third embodiment of the present invention before a housing 44 is fixed to a body 41, and FIG. 13B is an arrow cross sectional view along line A—A in FIG. 13A.

Figure 14A:
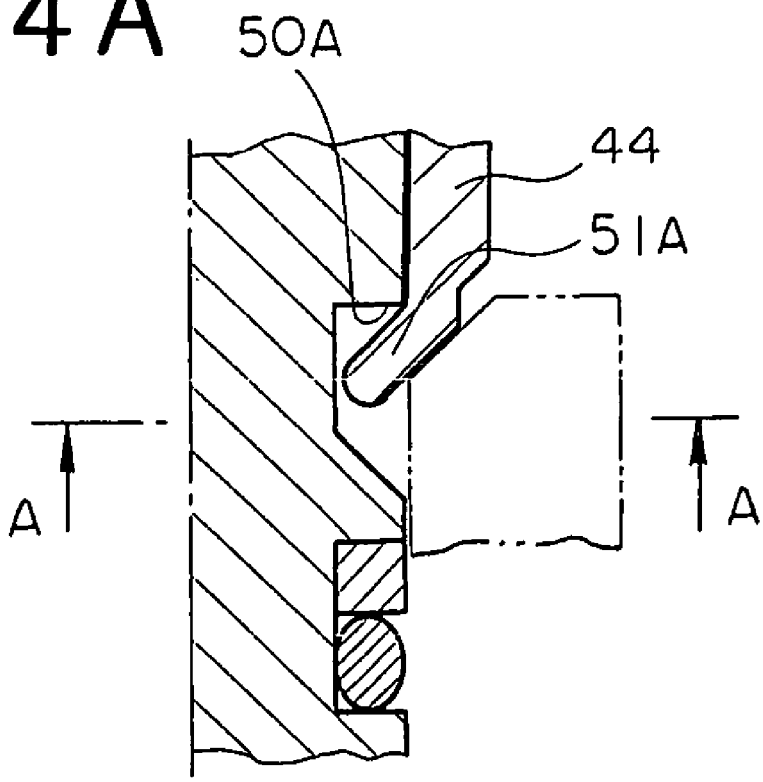
FIG. 14A is a partial cross sectional view of the electromagnetic valve according to the third embodiment of the present invention when the housing is fixed to the body.
Figure 14B:
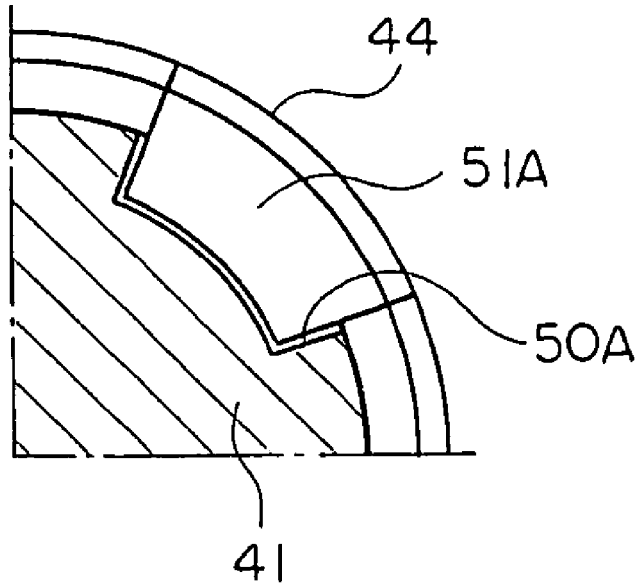
FIG. 14B is an arrow cross sectional view along line A—A in FIG. 14A.

FIG. 14A is a partial cross sectional view of the electromagnetic valve according to the third embodiment of the present invention when the housing 44 is fixed to the body 41, and FIG. 14B is an arrow cross sectional view along line A—A in FIG. 14A.

In this embodiment, a plurality of caulking segments 51A are formed at equal intervals in a circumferential direction of the housing 44, and a plurality of engagement groove portions 50A are also formed at equal intervals in a circumferential direction over the entire periphery of the body 41. The construction of this embodiment other than this is the same as that of the first embodiment.

According to this embodiment, the plurality of caulking segments 51A, which are formed by bending or flexing the lower end portion of the housing 44, are engaged with the plurality of engagement groove portions 50A, respectively. As a result, the relative positioning of the body 41 and the housing 44 in the circumferential direction can be made easily.

In the above-mentioned embodiments, the amateur 45 is attracted or sucked to the core 46 by energizing the solenoid 47 upon opening of the electromagnetic valve, so that one end of the plunger 40 is thereby caused to separate from the valve seat 42 against the resilient force of the spring 48. However, the present invention is, of course, applicable to such an electromagnetic valve in which upon opening of the electromagnetic valve, one end of the plunger is urged to separate from the valve seat in a direction away from the spring under the action of the resilient force thereof, whereas upon closure of the electromagnetic valve, the armature is magnetically attracted or sucked to the core by energizing the solenoid so that the one end of the plunger is forced to collide with the valve seat.

Moreover, the present invention is, of course, not limited to electromagnetic valves for high-pressure fuel supply systems. For instance, the present invention is also applicable to electromagnetic valves for fuel injection.

Further, although the engagement groove 50 is formed over the entire circumference of the body 41, but a plurality of engagement grooves may be formed at intervals in a circumferential direction of the body 41.

While the invention has been described in terms of a preferred embodiment, those skilled in the art will recognize that the invention can be practiced with modifications within the spirit and scope of the appended claims.

What is claimed is:

1. An electromagnetic valve comprising:

a solenoid;

a plunger arranged on an axis of said solenoid for axial movement therealong, a body in which said plunger is slidably received;

a housing in which said body is fixedly arranged;

a valve seat which is arranged in opposition to one end of said plunger, and which the one end of said plunger is moved to contact with and separate from; and a spring for urging said plunger in a direction toward or away from said valve seat;

wherein said body has an engagement groove, into which one end of said housing is flexed toward said body to form a caulking portion, by which said body and said housing are integrally coupled with each other, wherein said solenoid is not disposed entirely within said housing, and wherein said caulking portion has a tip end which is not in contact with a bottom of said engagement groove.

2. The electromagnetic valve as set forth in claim 1, wherein said electromagnetic valve comprises an electromagnetic valve for use with a high-pressure fuel supply system for controlling, upon opening of said valve, an amount of fuel discharge of a fuel pump that supplies a high-pressure fuel to an internal combustion engine.

3. The electromagnetic valve as set forth in claim 1, wherein said plunger contacts said body.

4. The electromagnetic valve as set forth in claim 3, further comprising a fluid passage disposed in said plunger.

5. The electromagnetic valve as set forth in claim 1, further comprising a fluid passage disposed in said plunger.

6. An electromagnetic valve comprising:

a solenoid;

a plunger arranged on an axis of said solenoid for axial movement therealong;

a body in which said plunger is slidably received;

a housing in which said body is fixedly arranged;

a valve seat which is arranged in opposition to one end of said plunger, and which the one end of said plunger is moved to contact with and separate from; and a spring for urging said plunger in a direction toward or away from said valve seat;

wherein said body has an engagement groove, into which one end of said housing is flexed toward said body to form a caulking portion, by which said body and said housing are integrally coupled with each other, wherein said solenoid is not disposed entirely within said housing, and wherein the ratio (E/D) of a bent length E of said caulking portion to a depth D of said engagement groove is in a range of from 1.5 to 1.6.

7. The electromagnetic valve as set forth in claim 6, wherein said electromagnetic valve comprises an electromagnetic valve for use with a high-pressure fuel supply system for controlling, upon opening of said valve, an amount of fuel discharge of a fuel pump that supplies a high-pressure fuel to an internal combustion engine.

8. The electromagnetic valve as set forth in claim 6, wherein said plunger contacts said body.

9. The electromagnetic valve as set forth in claim 8, further comprising a fluid passage disposed in said plunger.

10. The electromagnetic valve as set forth in claim 6, further comprising a fluid passage disposed in said plunger.

11. An electromagnetic valve comprising:

a solenoid;

a plunger arranged on an axis of said solenoid for axial movement therealong;

a body in which said plunger is slidably received;

a housing in which said body is fixedly arranged;

a valve seat which is arranged in opposition to one end of said plunger, and which the one end of said plunger is moved to contact with and separate from; and a spring for urging said plunger in a direction toward or away from said valve seat;

wherein said body has an engagement groove, into which one end of said housing is flexed toward said body to form a caulking portion, by which said body and said housing are integrally coupled with each other, wherein said solenoid is not disposed entirely within said housing, and wherein said caulking portion comprises a plurality of caulking segments arranged at intervals in a circumferential direction of said housing.

12. The electromagnetic valve as set forth in claim 11, wherein said electromagnetic valve comprises an electromagnetic valve for use with a high-pressure fuel supply system for controlling, upon opening of said valve, an amount of fuel discharge of a fuel pump that supplies a high-pressure fuel to an internal combustion engine.

13. The electromagnetic valve as set forth in claim 11, wherein said plunger contacts said body.

14. The electromagnetic valve as set forth in claim 13, further comprising a fluid passage disposed in said plunger.

15. The electromagnetic valve as set forth in claim 11, further comprising a fluid passage disposed in said plunger.

16. An electromagnetic valve comprising:

a solenoid;

a plunger arranged on an axis of said solenoid for axial movement therealong;

a body in which said plunger is slidably received;

a housing in which said body is fixedly arranged;

a valve seat which is arranged in opposition to one end of said plunger, and which the one end of said plunger is moved to contact with and separate from; and a spring for urging said plunger in a direction toward or away from said valve seat;

wherein said body has an engagement groove, into which one end of said housing is flexed toward said body to form a caulking portion, by which said body and said housing are integrally coupled with each other, wherein said solenoid is not disposed entirely within said housing, and wherein said engagement groove comprises a plurality of engagement groove portions at intervals in a circumferential direction of said body.

17. The electromagnetic valve as set forth in claim 16, wherein said electromagnetic valve comprises an electromagnetic valve for use with a high-pressure fuel supply system for controlling, upon opening of said valve, an amount of fuel discharge of a fuel pump that supplies a high-pressure fuel to an internal combustion engine.

18. The electromagnetic valve as set forth in claim 16, wherein said plunger contacts said body.

19. The electromagnetic valve as set forth in claim 18, further comprising a fluid passage disposed in said plunger.

20. The electromagnetic valve as set forth in claim 16, further comprising a fluid passage disposed in said plunger.

* * * * *